US009488045B2

(12) United States Patent
Clausen et al.

(10) Patent No.: US 9,488,045 B2
(45) Date of Patent: Nov. 8, 2016

(54) SYSTEM AND METHOD FOR CONTROLLING A DOWNHOLE TOOL

(71) Applicant: National Oilwell Varco, L.P., Houston, TX (US)

(72) Inventors: Jeffery Clausen, Houston, TX (US); Jonathan Ryan Prill, Edmonton (CA); Rami Zewail, Edmonton (CA)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 226 days.

(21) Appl. No.: 14/220,743

(22) Filed: Mar. 20, 2014

(65) Prior Publication Data

US 2014/0284104 A1 Sep. 25, 2014

Related U.S. Application Data

(60) Provisional application No. 61/803,696, filed on Mar. 20, 2013.

(51) Int. Cl.

| | |
|---|---|
| ***G01V 3/00*** | (2006.01) |
| ***E21B 47/12*** | (2012.01) |
| ***E21B 47/16*** | (2006.01) |
| ***E21B 7/06*** | (2006.01) |

(52) U.S. Cl.
CPC ..... *E21B 47/12* (2013.01); *E21B 7/068* (2013.01); *E21B 47/16* (2013.01)

(58) Field of Classification Search
CPC ..... E21B 47/12; E21B 47/122; E21B 7/04; E21B 7/068; E21B 3/00; E21B 3/02; E21B 3/025; E21B 3/03; E21B 44/00; E21B 44/02; E21B 44/04; E21B 45/00
See application file for complete search history.

(56) References Cited

U.S. PATENT DOCUMENTS

| | | | | |
|---|---|---|---|---|
| 4,763,258 A * | 8/1988 | Engelder | ..... | E21B 47/12 340/853.3 |
| 5,803,185 A * | 9/1998 | Barr | ..... | E21B 7/06 175/45 |
| 6,267,185 B1 | 7/2001 | Mougel et al. | | |

(Continued)

FOREIGN PATENT DOCUMENTS

GB 2352743 A 2/2001

OTHER PUBLICATIONS

International Application No. PCT/US2014/031334, International Search Report and Written Opinion dated Jan. 15, 2015, 12 pages.

*Primary Examiner* — Ryan Sherwin
(74) *Attorney, Agent, or Firm* — Conley Rose, P.C.

(57) ABSTRACT

A system and method for communicating with a downhole tool. A downhole tool includes a downlink receiver and a command actuator. The downlink receiver receives control information, encoded in rotation of the tool, that controls operation of the tool. The downlink receiver includes a rotation sensor and a decoder. The rotation sensor senses rotation of the tool about a longitudinal axis. The decoder demarcates fields of the control information based on rotation state transitions sensed by the rotation sensor. The rotation state transitions are transitions between a rotating state and a non-rotating state. The decoder also decodes a control value for controlling the tool based on a duration of a field of the control information. The control value is wholly encoded in the field, and the field is encoded as a non-rotating state of the tool. The command actuator applies the control value to control operation of the tool.

21 Claims, 10 Drawing Sheets

(56) References Cited

U.S. PATENT DOCUMENTS

| | | | | |
|---|---|---|---|---|
| 6,847,304 | B1 * | 1/2005 | McLoughlin | E21B 47/12 175/45 |
| 7,013,994 | B2 | 3/2006 | Eddison | |
| 9,133,682 | B2 | 9/2015 | Tahoun et al. | |
| 2005/0001737 | A1 | 1/2005 | Baron et al. | |
| 2006/0185900 | A1 | 8/2006 | Jones et al. | |
| 2011/0286309 | A1 | 11/2011 | Sugiura | |
| 2013/0206401 | A1 | 8/2013 | Bhoite et al. | |
| 2014/0124195 | A1 | 5/2014 | Tahoun et al. | |

* cited by examiner

SYSTEM AND METHOD FOR CONTROLLING A DOWNHOLE TOOL

CROSS REFERENCE TO RELATED APPLICATIONS

This application is a non-provisional application claiming priority to provisional application Ser. No. 61/803,696, filed on Mar. 20, 2013, entitled "System and Method for Controlling a Downhole Tool," the entire disclosure of which is incorporated by reference herein.

BACKGROUND

In the drilling of oil and gas wells, various techniques for providing communication between a surface system and equipment in a borehole have been devised. Such communication is generally directed to providing control over the function of a downhole tool from the surface, and/or providing information indicative of downhole conditions (e.g., borehole environmental conditions, tool conditions, etc.) to the surface. Exemplary downhole communication techniques include modulation of drilling fluid (mud) pressure or flow rate, communication via wireline or wired drill pipe, electromagnetic communication, acoustic communication, etc. Each technique has its advantages and disadvantages. For example, the mud column provides a convenient medium for communication because the circulation of drilling fluid is needed to clean and maintain pressure in the borehole. However, mud pressure modulation can be unreliable because the drilling fluid is susceptible to pressure changes not induced by a modulator of the communication system (e.g., changes in formation pressure). Mud flowrate and pressure are also affected when communication tools are run below a pulsing device, such as a MWD or mud motor, this can make signal decoding less reliable and more complex. Mud pulses also get degraded as the distance from the surface to the tool increases requiring the use of increasing time intervals between commands. Current systems also require the use of many different codes to send specific downlinks to the tool.

SUMMARY

A system and method for communicating with a downhole tool are disclosed herein. In one embodiment, a system for downhole communication includes a downhole tool. The downhole tool includes a downlink receiver and a command actuator. The downlink receiver is to receive control information that controls operation of the downhole tool. The control information is encoded in rotation of the downhole tool. The downlink receiver includes a rotation sensor and a decoder. The rotation sensor is configured to sense rotation of the downhole tool about a longitudinal axis of the downhole tool. The decoder is configured to demarcate fields of the control information based on rotation state transitions sensed by the rotation sensor. The rotation state transitions are transitions between a rotating state and a non-rotating state of the downhole tool. The decoder is also configured to decode a control value for controlling the downhole tool based on a duration of a field of the control information. The control value is wholly encoded in the field, and the field is encoded as a non-rotating state of the downhole tool. The command actuator applies the control value to control operation of the downhole tool.

In an embodiment, a method for downhole communication includes rotating a downhole tool at a first rotation rate to place the downhole tool in a rotating state. Rotation of the downhole tool is halted to place the downhole tool in a non-rotating state. Control information for controlling the downhole tool is encoded in a series of transitions between the rotating state and the non-rotating state. The transitions between the rotating state and the non-rotating state are detected by the downhole tool. Fields of the control information are demarcated by the downhole tool based on the detected transitions. A control value for controlling the downhole tool is decoded by the downhole tool based on a duration of a field of the control information. The control value is wholly encoded in the non-rotating state. The control value is applied to control operation of the downhole tool.

In an embodiment, a method for downhole communication includes transmitting control information from a surface location to a downhole tool disposed in a borehole by repetitively raising or lowering a downhole tool in a borehole. Motion of the downhole tool along a longitudinal axis of the downhole tool is detected by the downhole tool. The command information is extracted from the motion, by the downhole tool, by demarcating fields of the control information based on the detected motion of the downhole tool along the longitudinal axis. The control information extracted from the motion is applied by the downhole tool to control the operation of the downhole tool.

In an embodiment, a method for downhole communication includes rotating a drill string in a first direction via a drill string rotation mechanism disposed at a surface location. During the rotating in the first direction, a downhole motor disposed in the drill string is successively engaged and disengaged to cause reversals in direction of rotation of a downhole tool disposed downhole of the downhole motor in the drill string. The timing of the reversals in direction of rotation encodes control information for controlling the operation of the downhole tool. The reversals in direction of rotation are detected by the downhole tool. The control information is extracted from the rotation, by the downhole tool, by demarcating fields of the control information based on the detected reversals in direction of rotation. The extracted control information is applied by the downhole tool to control operation of the downhole tool.

In an embodiment, a system for downhole communication includes a downhole tool. The downhole tool includes a downlink receiver and a command actuator. The downlink receiver is to receive control information that controls operation of the downhole tool. The control information encoded in motion of the downhole tool. The downlink receiver includes a first sensor and a decoder. The first sensor is configured to sense motion of the downhole tool along a longitudinal axis of the downhole tool. The decoder is configured to extract the control information from the motion of the downhole tool, and to demarcate fields of the control information based on sensed motions of the downhole tool along the longitudinal axis. The command actuator applies decoded control information provided by the downlink receiver to control operation of the downhole tool.

The downlink receiver may include a second sensor configured to detect rotation of the downhole tool about the longitudinal axis. The decoder may be configured to extract the control information based on detected rotation of the downhole tool being at a predetermined rate during the sensed motions of the downhole tool along the longitudinal axis.

The downlink receiver may be configured to identify each sensed initiation of axial motion along the longitudinal axis as change of state of the control information.

The downlink receiver may configured to identify a first sensed initiation of axial motion along the longitudinal axis followed by a second sensed initiation of axial motion along the longitudinal axis as initiation of a preamble field of the control information. The downlink receiver may include a second sensor configured to detect rotation of the downhole tool about the longitudinal axis. The decoder may be configured to demarcate fields of the control information based on sensed changes in rate of rotation of the downhole tool.

The downlink receiver may be configured to identify a first sensed initiation of axial motion along the longitudinal axis as initiation of a preamble field of the control information transmission; and to identify a second sensed initiation of axial motion along the longitudinal axis as termination of the control information. The downlink receiver may include a second sensor configured to detect rotation of the downhole tool about the longitudinal axis; wherein the decoder is configured to demarcate fields of the control information based on sensed changes in rate of rotation of the downhole tool.

The system may further include a plurality of joints of drill pipe coupling the downhole tool to surface equipment.

The downhole tool may be a reamer that includes a blade for expanding a diameter of a borehole. The downlink receiver may be configured to decode from axial and rotational motion of the downhole tool, information for controlling a position of the blade.

The downlink receiver may include a timer configured to measure a time duration of each identified field of the control information. The downlink receiver is configured to determine a value of the control information to be applied to control the downhole tool in correspondence to the time duration of a given field of the control information.

In an embodiment, a system for downhole communication includes a downhole tool. The downhole tool includes a downlink receiver and a command actuator. The downlink receiver is to receive control information that controls operation of the downhole tool. The control information is encoded in rotation of the downhole tool. The downlink receiver includes a rotation sensor, and a decoder. The rotation sensor is configured to sense rotation of the downhole tool about a longitudinal axis of the downhole tool. The decoder is configured to demarcate fields of the control information based on reversals of rotational direction sensed by the rotation sensor. The command actuator applies decoded control information provided by the downlink receiver to control operation of the downhole tool.

A drill string may couple the downhole tool to surface equipment. The surface equipment is configured to rotate the drill string in a first direction. The drill string includes a downhole motor disposed in the drill string uphole of the downhole tool. The downhole motor is configured to reverse the rotational direction of the downhole tool by rotating the downhole tool in a second direction that is opposite the first direction while the drill string uphole of the downhole motor rotates in the first direction.

The downlink receiver may include a timer configured to measure a time interval between each reversal of rotational direction. The downlink receiver may be configured to determine a value of the control information to be applied to control the downhole tool in correspondence to the time interval between two predetermined reversals of rotation.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form, and some details of conventional elements may not be shown in the interest of clarity and conciseness.

NOTATION AND NOMENCLATURE

Figure 1:
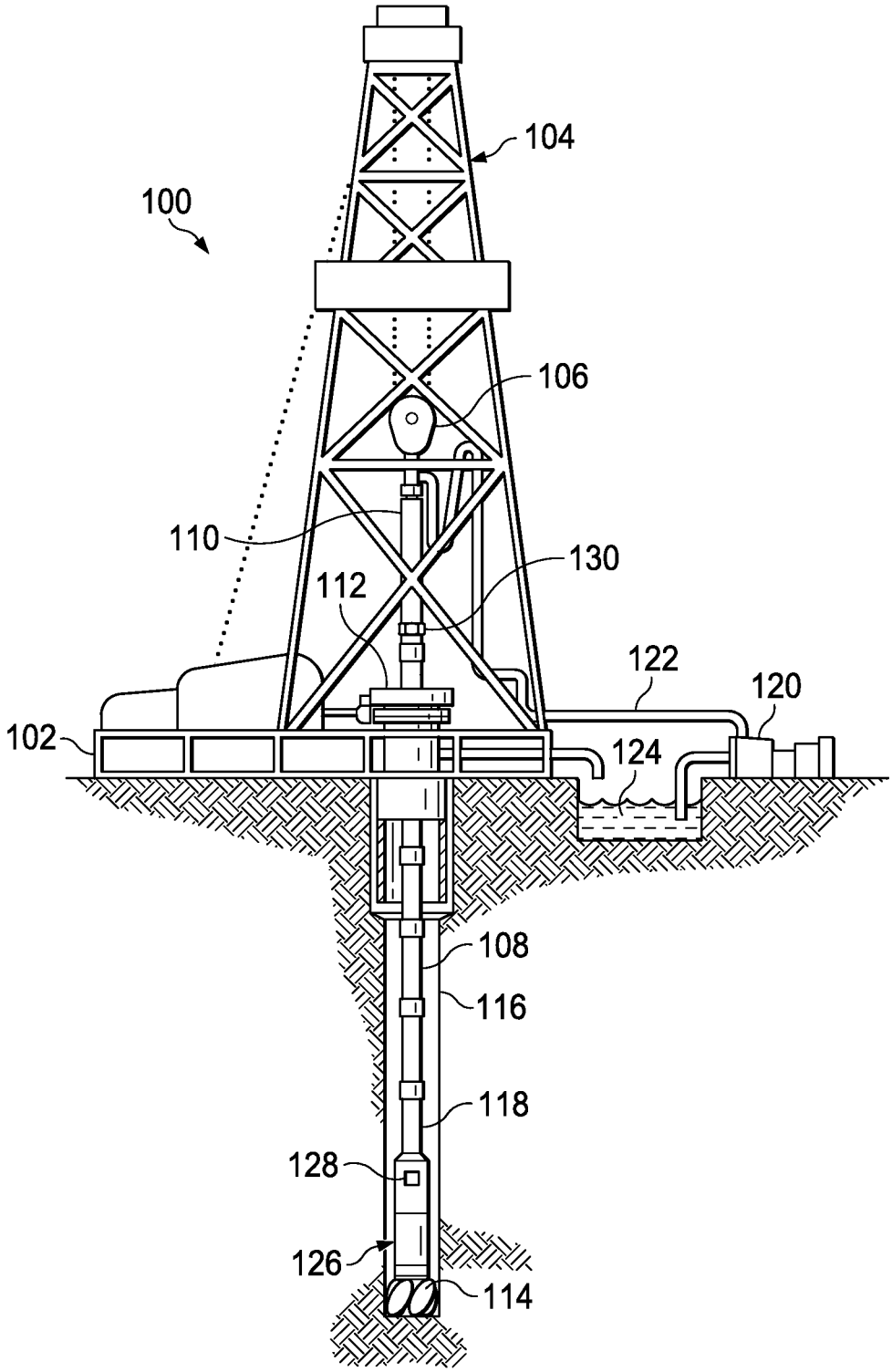
FIG. 1 shows a drilling system configured for downhole communication in accordance with principles disclosed herein.

Certain terms are used throughout the following description and claims to refer to particular system components. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through direct engagement of the devices or through an indirect connection via other devices and connections. Further, the term "software" includes any executable code capable of running on a processor, regardless of the media used to store the software. Thus, code stored in memory (e.g., non-volatile memory), and sometimes referred to as "embedded firmware," is included within the definition of software. The recitation "based on" is intended to mean "based at least in part on." Therefore, if X is based on Y, X may be based on Y and any number of other factors.

DETAILED DESCRIPTION

In the drawings and description that follow, like parts are typically marked throughout the specification and drawings with the same reference numerals. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings and components of the embodiments discussed below may be employed separately or in any suitable combination to produce desired results.

The downhole communication systems employed in oil and gas industry applications are subject to varying requirements. Tools that acquire a large volume of data may require a high bandwidth communication link for transfer of data from the tool to surface equipment (uplink). Similarly, a tool that requires real-time control from the surface may require a high-speed communication link for transfer of data from the surface equipment to the downhole tool (downlink). In other applications, reliability and cost are important considerations. For example, downhole tools that do not require real-time control may be managed via a low bandwidth downlink that can preferably be implemented with fewer specialized components and at lower cost than a higher bandwidth communication system.

Embodiments of the downlink communication system disclosed herein provide control of downhole tool functionality without use of specialized communication media that may increase system cost. Embodiments also provide reliable transfer of control information from the surface to a downhole tool that is not subject to interference from outside noise sources and is free from signal degradation due to increasing distance from the surface. The downlink communication system disclosed herein employs drill string rotation and/or axial movement to transfer a command from the surface to the downhole tool. In some embodiments, an analog command signal (with potentially infinite resolution) is transmitted using pulse width modulation of the drill string rotation or pulse modulation for combination of rotation and axial movement signal. Embodiments employ time based commands to make it simple for operators to send commands to the tool without the need to have a database to give them a multitude of command sequences for each input value desired.

FIG. 1 shows a drilling system 100 configured for downhole communication in accordance with principles disclosed herein. A drilling platform 102 supports a derrick 104 having a traveling block 106 for raising and lowering a drill string 108. A kelly 110 supports the drill string 108 as it is lowered through a rotary table 112. In some embodiments, a top drive is used to rotate the drill string 108 in place of the kelly 110 and the rotary table 112. A drill bit 114 is driven by a downhole motor and/or rotation of the drill string 108. As drill bit 114 rotates, it creates a borehole 116 that passes through various subsurface formations. A pump 120 circulates drilling fluid through a feed pipe 122 to kelly 110, downhole through the interior of drill string 108, through orifices in drill bit 114, back to the surface via the annulus around drill string 108, and into a retention pit 124. The drilling fluid transports cuttings from the borehole into the pit 124 and aids in maintaining the integrity of the borehole 116.

The drill string 108 is made up of various components, including drill pipe 118, drill bit 114, and other downhole tools. The drill pipe 118 may be standard drill pipe or wired drill pipe. The drill string 108 includes a downhole tool 126 that receives control information from the surface. The downhole tool 126 may be, for example, a steering tool, such as is described in U.S. Pat. Pub. US2011/0036631a1, a reamer, a circulating sub, a positive displacement motor or turbine, a variable thruster for applying WOB, or any other downhole equipment that receives control information from the equipment disposed at the surface. To enable the transfer of control information from the surface to the downhole tool 126, the downhole tool 126 includes a downlink receiver 128. The downlink receiver 128 detects control information (e.g., commands, parameters, etc.) transmitted from equipment at the surface as disclosed herein. The control information may direct the operation or configuration of the downhole tool 126, transfer operational parameters to the downhole tool 126, etc.

Some embodiments of the downlink receiver 128 detect rotation of the drill string 108 and decode commands based on the duration of rotation of the drill string 108. Some embodiments of the downlink receiver 128 may use a combination of duration of rotation and axial movements or changes in direction or any combination thereof to decode commands. Accordingly, the downlink receiver 128 may interpret a rotation of the drill string 108 for a first duration as a first command, and rotation of the drill string 108 for a second duration (e.g., longer than the first duration) as a second command. Alternatively the downlink receiver 128 may interpret a rotation and axial movement of the drill string 108 for a first duration as a first command, and lack of rotation or movement of the drill string 108 for a second duration (e.g., longer than the first duration) as a second command. Some embodiments may decode commands based on the speed of rotation of the drill string 108, the number of revolutions of the drill string 108, duration of axial motion of the drill string 108, drilling fluid pressure, drilling fluid flow rate, etc. The downlink receiver 128 and the control information transfer techniques disclosed herein allow for reliable transfer of control information from the surface equipment to the downhole tool 126 while using standard (not wired) drill pipe.

While the system 100 is illustrated with reference to an onshore well and drilling system, embodiments of the system 100 are also applicable to control of downhole tools in offshore wells. In such embodiments, the drill string 108 may extend from a surface platform through a riser assembly, a subsea blowout preventer, and a subsea wellhead into the subsea formations.

FIGS. 2A-2E show diagrams of exemplary downlink command sequences for downhole communication in accordance with principles disclosed herein. In FIGS. 2A-2E information is transferred from the surface equipment to the downhole tool 126 via rotation and/or axial movement of the downhole tool 126. Rotation of the downhole tool 126, for transfer of control information, may be implemented by rotation of the drill string 108 from the surface (via rotary table, top drive, etc.) and/or by actuation of a downhole motor (mud motor) disposed in the drill string 108 above the downhole tool 126. Accordingly, from the perspective of the surface equipment, transfer of control information may be effectuated by controlling the operation of the mud motor. Thus, the surface equipment may modulate the flow of drilling fluid through the mud motor to transfer the control information to the downhole tool 126 via rotation. Axial movement of the downhole tool 126 may effectuated by, for example, raising and/or lowering the drill string 108 via the traveling block 106.

Figure 2A:
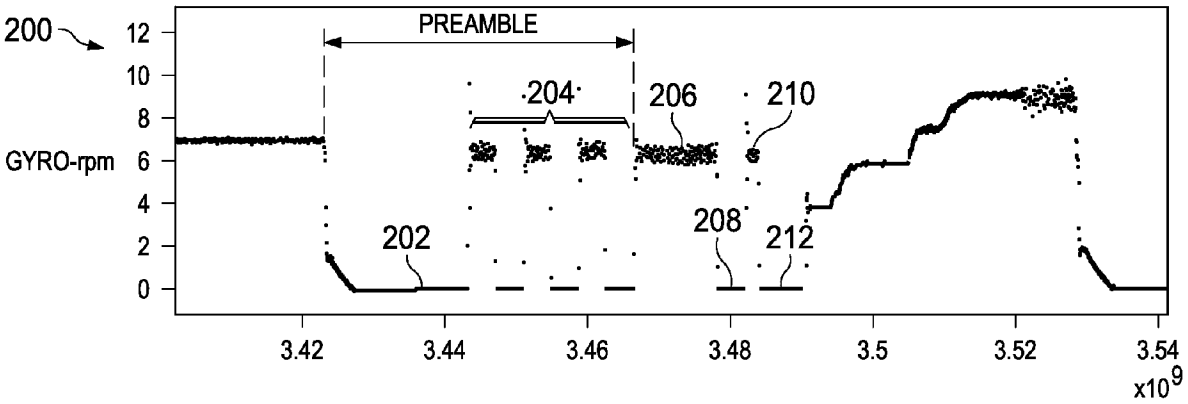
FIGS. 2A-2F show diagrams of exemplary downlink command sequences for downhole communication in accordance with principles disclosed herein.

FIG. 2A shows a diagram of an exemplary downlink command sequence 200 transmitted from equipment at the surface and received by the downhole tool 126 in accordance with principles disclosed herein. The downhole tool 126 monitors its rotation and extracts command information from the detected rotation. The transfer sequence begins with a preamble field. During interval 202, the preamble portion of a control transfer is initiated by halting rotation of the downhole tool 126 for at a least a predetermined duration (e.g., 90 seconds). While interval 202 and other non-rotating intervals of the control transfer are illustrated as being zero revolutions-per-minute (RPM), embodiments of the downhole tool 126 may deem any rate of rotation less than a predetermined threshold rate of rotation (e.g., <1 RPM) to constitute a state of non-rotation.

The preamble portion of the transfer continues in interval 204 with a series of periods of rotation and non-rotation. Rotational periods may be 30 seconds in length, and non-rotational periods may also be 30 seconds in length. The number of sequential periods of rotation and non-rotation and the length of the rotational and non-rotational periods may vary in different embodiments of the system 100. While rotational periods of the interval 204 and other rotational periods of the control transfer are illustrated as being greater than six revolutions-per-minute, embodiments of the downhole tool 126 may deem any rate of rotation greater than a predetermined threshold rate of rotation (e.g., >5 RPM) to constitute a state of rotation.

The preamble is complete at the end of the interval 204, and control information (command, parameters, etc.) is transferred to the downhole tool 126 during rotational period 206. Control information may be transferred to the downhole tool 126 during the rotational period 206 by modulating the pulse width of the signal.

Any number of commands and/or parameters may be transferred to the downhole tool 126 using combinations of pulse width modulated sequences for the rotation levels and/or rotation directions and/or axial movements. For example, if the rotational period 206 is 60 seconds in length the downhole tool 126 may identify a first command, and if the rotational period 206 is 90 seconds in length the downhole tool 126 may identify a second command that is different from the first command. Similarly, parameter values may be transferred based on the length of the rotational period 206. For example, a longer rotational period 206 may indicate a higher parameter value.

The rotational period 206 (and associated control information transfer) ends as the rotation of the downhole tool 126 is halted during interval 208 (e.g., 30 seconds). At the end of interval 208, another transfer of control information may be performed during the rotational period 210, where the duration of the rotational period 210 determines what control information is transferred. Thus, any number of commands and/or parameters may be transferred to the downhole tool 126 following the preamble. In command sequence 200, after rotational period 210, rotation of the downhole tool 126 is halted during interval 212, indicating that the transfer of control information is complete, and the downhole tool 126 executes the received commands, applies the received parameters, etc.

Figure 2B:
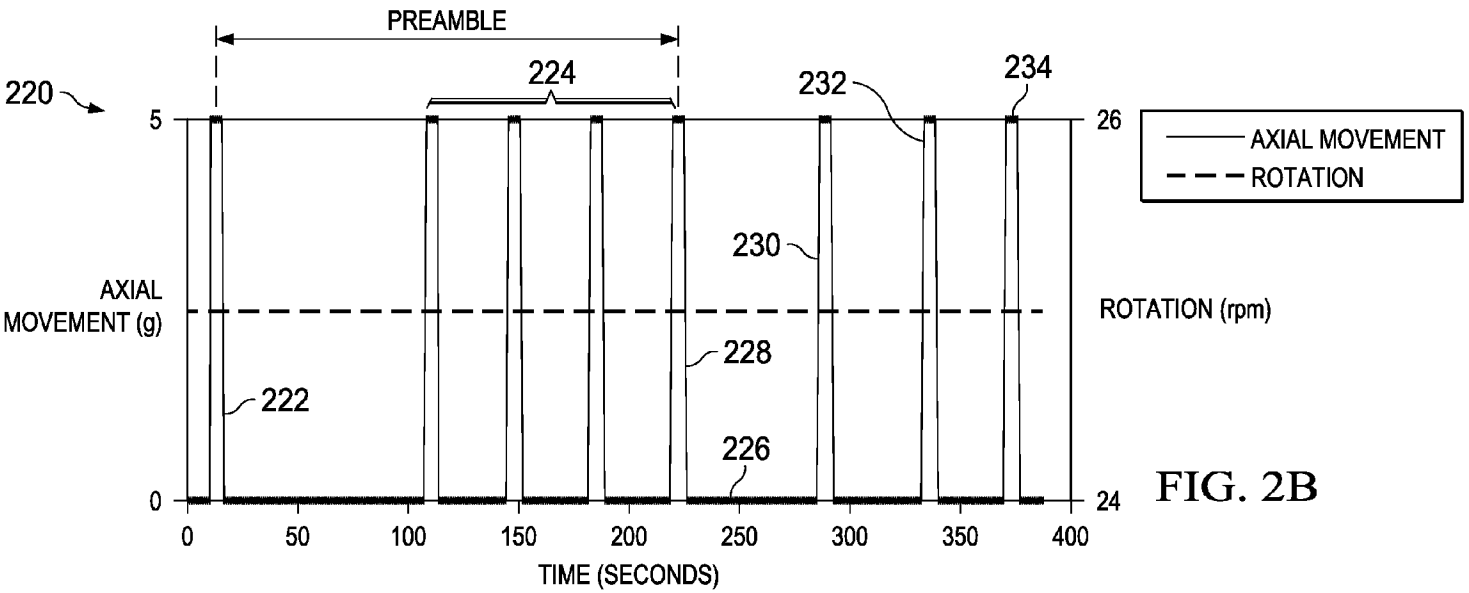

FIG. 2B shows a diagram of a downlink command sequence 220 transmitted from equipment at the surface and received by the downhole tool 126 in accordance with principles disclosed herein. The downhole tool 126 monitors its rotation and axial movement and extracts command information from the detected rotation and axial motion. In the command sequence 220, the downhole tool 126 is rotated at a single rate (i.e., a single RPM is maintained) and the axial movements of the tool 126 define changes in (e.g., breaks in) the downlink code. The preamble is initiated by an axial movement 222 of the downhole tool 126 while maintaining rotation. After a predetermined time interval (e.g., 90 seconds) the preamble continues with the tool 126 being repetitively raised and/or lowered in axial motions 224. For example, in command sequence 220, the preamble continues with the tool 126 being axially moved four times with 30 seconds separating axial movements. The command information is defined by the duration 226, which is delineated by axial motions 228 and 230. The duration of rotation bounded by axial movements 230 and 232 specifies a second command parameter. The command sequence 220 may terminate and complete the command transfer with cessation of rotation or a terminal axial movement 234.

Figure 2C:
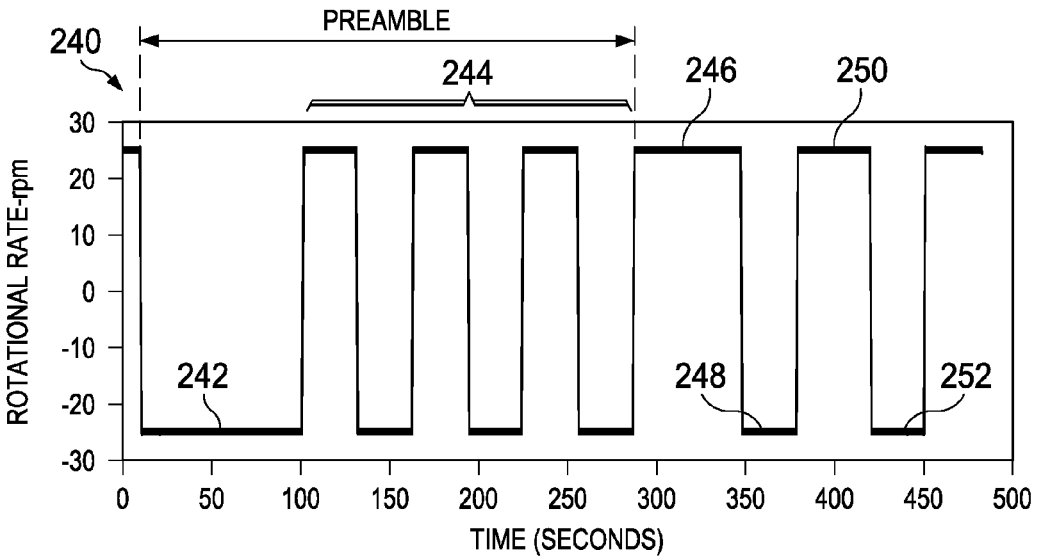

FIG. 2C shows a diagram of a downlink command sequence 240 transmitted from equipment at the surface and received by the downhole tool 126 in accordance with principles disclosed herein. The downhole tool 126 monitors and extracts command information from the detected direction and duration of rotation of the tool 126 and/or the downlink receiver 128. The drill string 108 may include a control system and a positive displacement motor that can rotate the tool 126 and/or the downlink receiver 128 in a first direction (e.g., a left hand direction). In some embodiments (e.g., as described in U.S. Pat. Pub. 2011/0036631) tool 126 has a left hand spinning mud motor inside of the body of the tool 126 that is connected to the downlink receiver 128, therefore when drilling fluid is flowing through tool 126 and the body of tool 126 is stationary, the downlink receiver 128 is independently being rotated left by the left hand spinning motor connected to the downlink receiver 128. When (e.g., as described in U.S. Pat. Pub. 2011/0036631) drilling fluid is not flowing through the tool 126 and the tool 126 is spinning to the right, the downlink receiver 128 is also spinning to the right since the left hand mud motor is not active. Thus, the system 100 may maintain rotation of the drill string 108 in a second direction (e.g., right hand rotation) from the surface, and engage the downhole motor to rotate the tool 126 and/or the downlink receiver 128 in the first direction. Accordingly, the system 100 may, while rotating the drill string 108 at a constant speed in the second direction, rotate the tool 126 and/or the downlink receiver 128 in the first direction. By engaging and disengaging the positive displacement motor, the system 100 can change the direction of rotation of the tool 126 and/or the downlink receiver 128. The downlink receiver 128 can detect the change in rotational direction, and decode therefrom a command sequence.

In the command sequence 240, prior to the preamble, the drill string 108 is rotating in the second direction with the downhole motor (e.g., disposed in the downhole tool 126) disengaged. The preamble begins by engaging the downhole motor to rotate the tool 126 and/or the downlink receiver 128 in the first direction for a predetermined interval 242 (e.g., 90 seconds). The preamble continues by repetitively disengaging and engaging the downhole motor to reverse the direction of rotation of the tool 126 and/or the downlink receiver 128. In the command sequence 240, preamble period 244 includes six reversals of rotation direction with rotation in each direction for approximately 30 seconds. Following the preamble, a command value is transferred by disengaging the downhole motor for the interval 246 where the length of the interval 246 defines the command value. Additional command values may be transferred by engaging the downhole motor for an interval 248 and disengaging the downhole motor for an interval 250 that defines the additional value. Following a final motor engagement interval 252, the command sequence is complete.

Figure 2D:
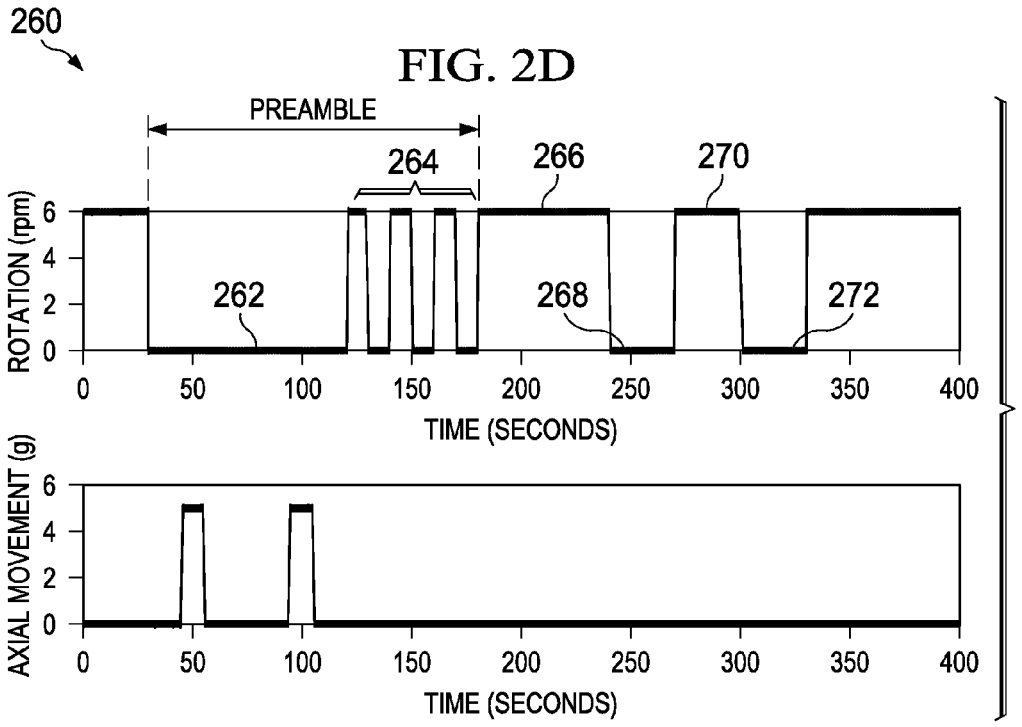

FIG. 2D shows an exemplary downlink command sequence 260 that includes both rotation and axial movement sequences transmitted from the equipment at the surface and received and interpreted by the downhole tool 126 in accordance with principles disclosed herein. The downhole tool 126 monitors both rotation and axial movement and extracts command information from the detected rotation and axial movement signals. The command sequence 260 begins with a preamble that incorporates rotation and axial movement signals.

During interval 262, the preamble portion of a control transfer is initiated by halting rotation of the downhole tool 126 for a pre-determined duration (e.g. 90 seconds). During interval 902, two axial movement pulses are transmitted to the downhole tool 126 by lowering or raising the tool 126 with sudden stop. Accordingly, the downhole tool 126 receives two axial movement pulses during the interval 902. While FIG. 2D shows the axial movement pulses as being 5 gs (5 times the acceleration of gravity), embodiments of the downhole tool 126 may deem any acceleration levels above a predetermined threshold to constitute an axial movement pulse. The preamble portion of the sequence 260 continues with a series of periods of rotation and non-rotation. The preamble is complete at the end of the interval 264, and control information (commands and/or parameters) are transferred in interval 266 (e.g., where the duration of the interval 266 defines the value of the command or parameter). Following an interval 268 of non-rotation, an additional command/parameter may be transferred in rotation interval 270. The command sequence 260 is terminated with non-rotation interval 272.

Figure 2E:
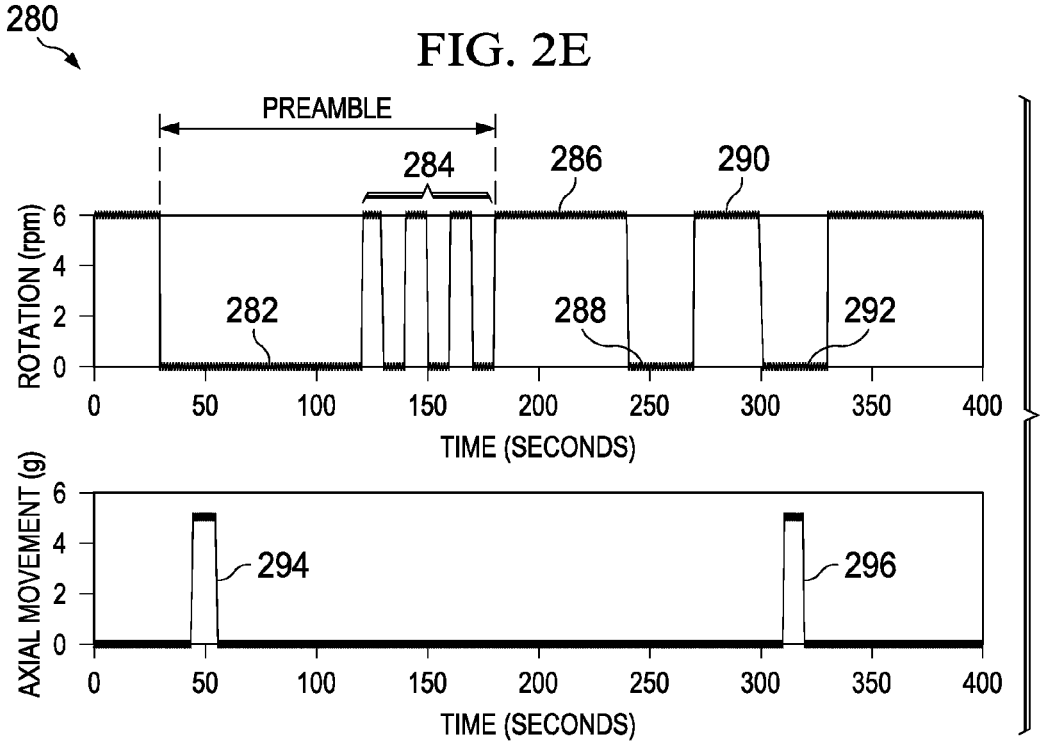

FIG. 2E shows an exemplary downlink command sequence 280 that includes rotation and axial movement sequences transmitted from the equipment at the surface and received and interpreted by the downhole tool 126 in accordance with principles disclosed herein. The length of the command sequence 280 is defined by a sequence initiation axial movement 294 and a sequence termination axial movement 296. Accordingly, a different set of commands may be transmitted by transmitting a first axial movement pulse 294 during the preamble period 282 and a second axial pulse 296 during the non-rotation interval 292.

In the command sequence 280 the preamble may be further defined by periods of rotation and non-rotation 284. Following the preamble, a command/parameter is defined by the duration of the rotation interval 286. Following an interval 288 of non-rotation, an additional command/parameter may be transferred in rotation interval 290.

Figure 2F:
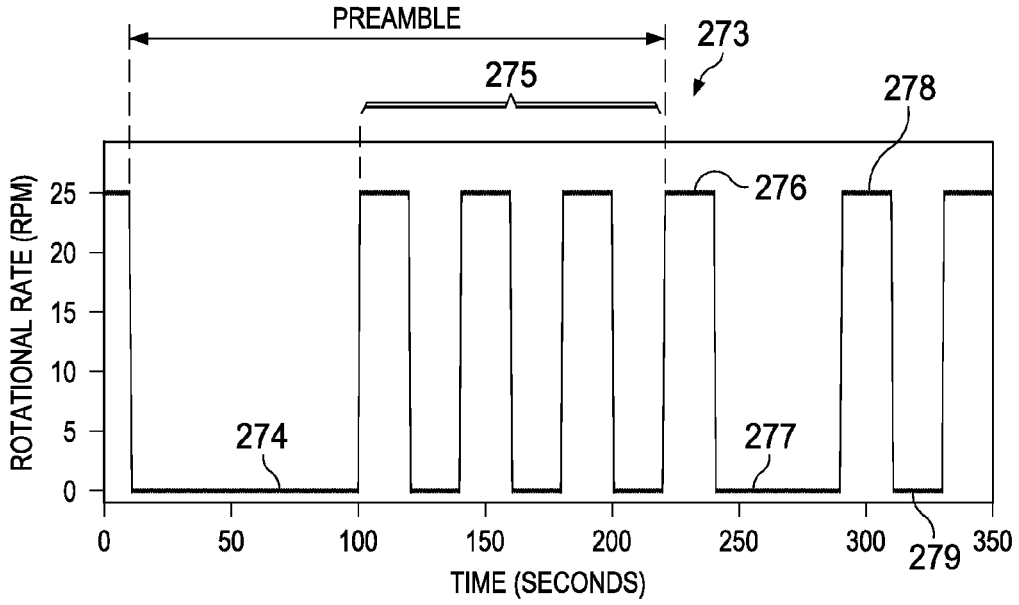

FIG. 2F shows an exemplary downlink command sequence 273 that includes a rotation sequence transmitted from the equipment at the surface and received and interpreted by the downhole tool 126 in accordance with principles disclosed herein. The downhole tool 126 monitors rotation and extracts command information from the detected rotation. The command sequence 273 begins with a preamble that incorporates rotation.

During interval 274, the preamble portion of a control transfer is initiated by halting rotation of the downhole tool 126 for a pre-determined duration (e.g., 90 seconds). The preamble portion of the sequence 273 continues with a series of periods of rotation and non-rotation. For example, following interval 274, preamble rotational periods may be 20 seconds in length, and non-rotational periods may also be 20 seconds in length. Thus, the preamble comprises a series of transitions between a rotating state in which the downhole tool 126 is rotated, and a non-rotating state in which rotation of the downhole tool 126 is halted. The preamble is complete at the end of the interval 275.

Following the preamble, a period of rotation 276 indicates to the downhole tool 126 that command/parameter values are to be transferred via intervals of non-rotation (i.e., the tool 126 is to apply active-low logic in interpreting the upcoming command/parameter sequence). That is, equipment at the surface will downlink control information (commands and/or parameters) to the downhole tool 126 by halting rotation of the downhole tool 126 for an interval of time as opposed to rotating the tool 126 for the interval. In some embodiments, the interval of rotation 276 specifies a polarity designation value, that indicates (e.g., by the duration of the interval 276) whether subsequent control transfer will be by rotation or by non-rotation.

In interval 277, control information (commands and/or parameters) is transferred by halting the rotation of the downhole tool 126 (e.g., the duration of the interval 277 defines the value of the command or parameter). In the sequence 273, only one command value is transferred, and the command sequence is terminated with rotation interval 278 followed by non-rotation interval 279. In other control information transfers, the intervals 277 and 278 may be repeated to transfer a plurality of control values (e.g., a command and associated parameters). In some embodiments, the non-rotation in the interval 277 may be defined as a rotation rate lower than a predetermined rate (e.g., <1 RPM). Similarly, rotation in rotation intervals (e.g., 276, 278) may be defined as a rotation rate higher than a predetermined rate (e.g., >10 RPM).

Figure 3:
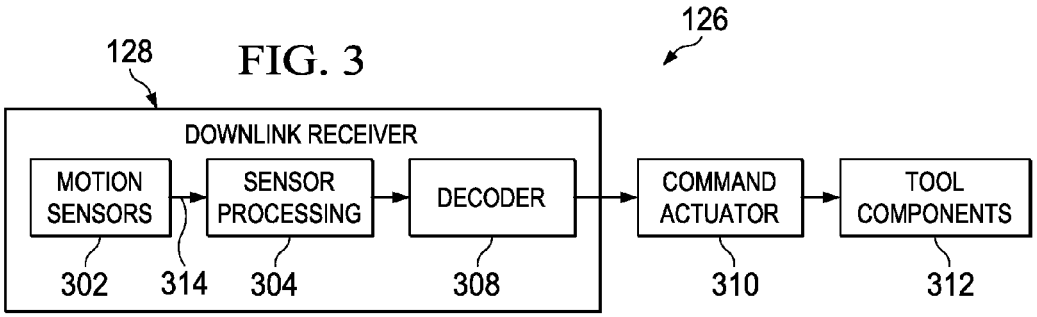
FIG. 3 shows a block diagram of a downhole tool that includes a downlink receiver in accordance with principles disclosed herein.

FIG. 3 shows a block diagram of the downhole tool 126 in accordance with principles disclosed herein. The downhole tool 126 includes a downlink receiver 128, a command actuator 308, and tool components 310. The downlink receiver 128 detects transfer of and decodes the control information conveyed from the surface equipment. The command actuator 308 executes commands and/or applies parameters decoded by the downlink receiver 128 to control the tool components 310. The command actuator 308 may include a processor or other circuitry or actuation system that controls or manages operation of the downhole tool 126 based on a received command or parameter. The tool components 310 may be valves, solenoids, motors or any other component of the downhole tool 126 that is controllable to affect operation of the downhole tool 126. The downhole tool 126 may also include a power source, such as battery, to provide power to the downlink receiver 128, the command actuator 308, etc.

The downlink receiver 128 includes one or more motion sensors 302, sensor processing 304, and a decoder 308. The motion sensors 302 detect movement of the downhole tool 126. The motion sensors 302 may include sensors that detect rotation of the tool 126, and sensors that detect axial movement of the tool 126. For example, the motion sensors 302 may include a gyroscope (e.g., a solid-state gyroscope), accelerometers, magnetometers, or other tachometric device for determining whether and optionally at what rate, the downhole tool 126 is rotating, and also may include an accelerometer or other sensor oriented to detect axial movement of the tool 126. The motion sensors 302 and the sensor processing 304 operate conjunctively to determine whether the downhole tool 126 is rotating and/or moving axially. Some embodiments of the motion sensors 302 and sensor processing 304 also determine at what rate the downhole tool 126 is rotating to allow assessment of rotation based on predetermined rotation rate thresholds as described herein.

The sensor processing 304 may include one or more timers to measure the intervals of rotation and non-rotation and/or intervals between axial motions that define the transfer of control information. For example, a timer can measure duration of non-rotation during the interval 202, measure duration of rotational periods and non-rotational periods in interval 204, duration of rotation in period 206, etc.

The decoder 308 determines whether control information is being transferred from the surface, and identifies the control information based on the motion information, and associated timing, provided by the sensor processing 304. For example, with regard to command sequence 200, the decoder 308 can identify a preamble of a control information transfer by comparing the sequence of rotation/non-rotation time values received from the sensor processing 304 to predetermined rotation/non-rotation time sequence values defining a preamble. Subsequent to identification of a preamble, the decoder 308 can identify a command and/or parameter value transferred based on the time value of the interval 206 received from the sensor processing 304. For example, the decoder 308 may include a table or other structure or information that relates the measured time of the interval 206 to a command/parameter value. The decoder 308 may apply similar decoding operations to decode the sequences 220, 240, 260, and 280.

The decoder 308 provides the identified command/parameter to the command actuator 310. The command actuator 310 implements the received command/parameter to affect the operation of the downhole tool 126. For example, the command actuator 310 may open or close a valve in the downhole tool 126 in response to receiving a valve control command.

Figure 4:
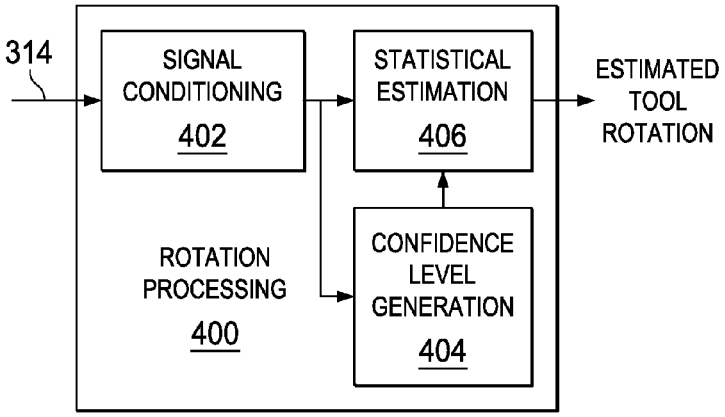
FIG. 4 shows a block diagram of a rotation processing module in accordance with principles disclosed herein.

As explained above, the sensor processing 304 processes sensor output signals 314 to determine whether the tool 126 is rotating and/or moving axially. FIG. 4 shows a block diagram of an embodiment of rotation processing module 400. The rotation processing module 400 estimates the rotation of the tool 126 based on signals 314 received from one or more rotation sensors of the motion sensors 314 (e.g., an accelerometer, gyroscope, and magnetometer). The rotation processing module 400 includes signal conditioning 402, confidence level generation 404, and statistical estimation 406. Rotation signals 318 are conditioned by signal conditioning 402. Confidence levels of each rotation sensor signal are generated based on different criteria (such as signal-to-noise ratio, inclination level, sensor failure) by the confidence level generation 404. The statistical estimation 406 estimates rotation by statistical weighted averaging (or kalman filter estimation) of the conditioned signals.

Embodiments of the downhole tool 126 can implement portions of the rotation timer 306, decoder 308, and/or command actuator 310 using dedicated circuitry (e.g., dedicated circuitry implemented in an discrete or integrated circuit). Some embodiments may use a combination of dedicated circuitry and a processor executing suitable software. For example, some portions of the downlink receiver 128 may be implemented using a processor or hardware circuitry. Selection of a hardware or processor/software implementation of embodiments is a design choice based on a variety of factors, such as cost, time to implement, and the ability to incorporate changed or additional functionality in the future.

Figure 5:
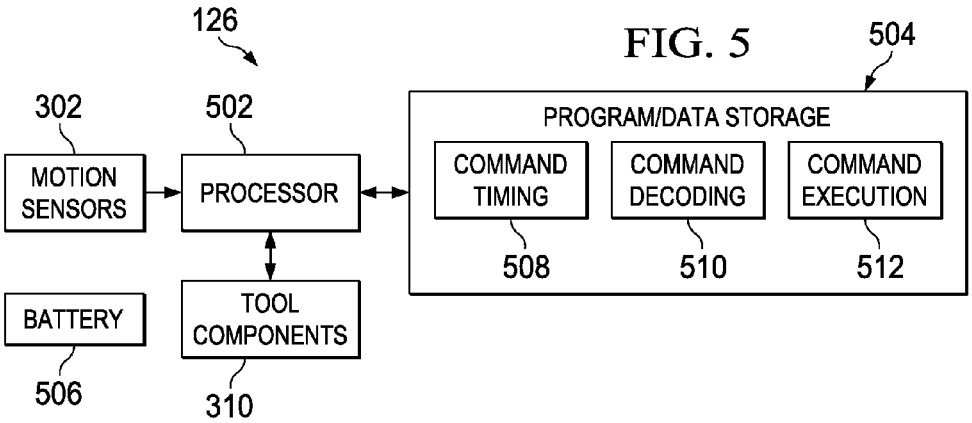
FIG. 5 shows a block diagram of downhole tool that includes a processor based downlink receiver in accordance with principles disclosed herein.

FIG. 5 shows a block diagram of an embodiment of the downhole tool 126 that includes a processor based downlink receiver 128 in accordance with principles disclosed herein. The downhole tool 126 of FIG. 5 includes the motion sensors 302 and tool components 312 as described with regard to FIG. 3. The downhole tool 126 of FIG. 5 also includes a processor 502, storage 504, and a battery 506. The battery 506 provides power to the processor 502 and other components of the downhole tool 126.

The processor 502 is a device that executes instructions to perform the command actuation, command decoding, and/or timing functions of the downhole tool 126. Suitable processors include, for example, general-purpose microprocessors, digital signal processors, and microcontrollers. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The storage 504 is a computer-readable storage device that stores instructions to be executed by the processor 502. When executed, the instructions cause the processor 502 to perform the various downhole tool control operations disclosed herein. A computer readable storage device may include volatile storage such as random access memory, non-volatile storage (e.g., FLASH storage, read-only-memory, etc.), or combinations thereof. Instructions stored in the storage 504 may cause the processor 502 identify rotation and/or axial motion based on signals 314, to measure the times of rotation/non-rotation/axial motion intervals, to identify commands/parameters transferred based on the measured times, and to execute the identified commands or apply the identified parameters.

The storage 504 includes a command timing module 508, a command decoding module 510, and a command execution module 512. The command timing module 508 includes instructions that cause the processor 502 to measure the rotation times/non-rotation times/axial motion times associated with control information transfer. The processor 502 may implement the measurement via timer circuitry or instruction-based timing. The command decoding module 510 causes the processor 502 to identify preambles, commands, parameters, etc. based on the rotation/non-rotation/axial motion time sequences and the measured time of control information transfer intervals 206, 210, etc. The command execution module 512 causes the processor 502 to perform operations needed to implement a received command or apply a received parameter. For example, instructions of the command execution module 512 may cause the processor to actuate a valve, a solenoid, or other component of the downhole tool 126 in accordance with the identified command or parameter.

Figure 6:
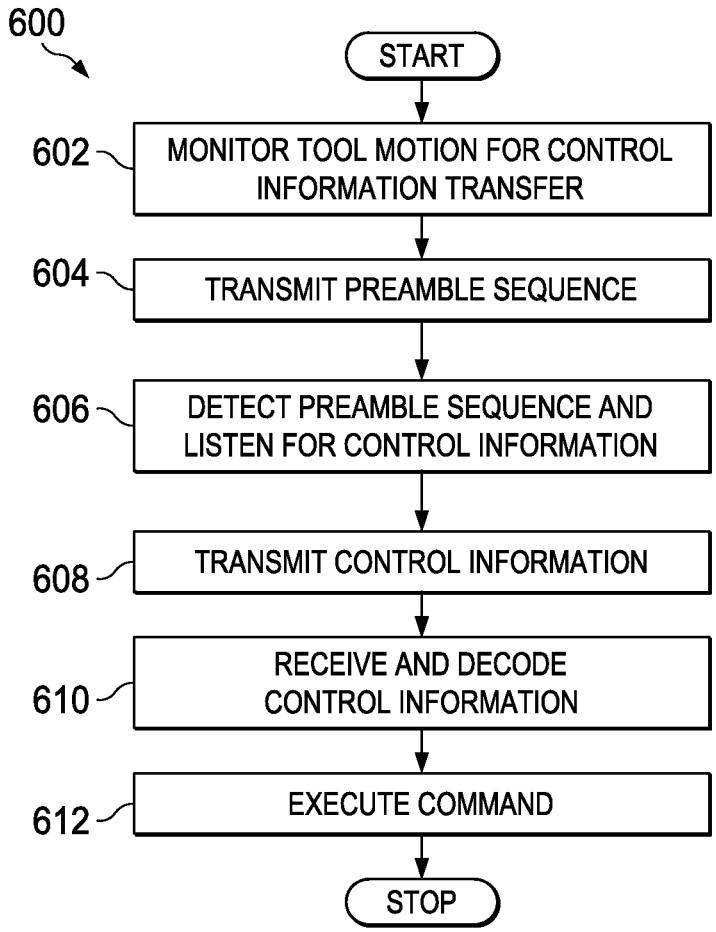
FIG. 6 shows a flow diagram for a method for communicating with a downhole tool in accordance with principles disclosed herein.

FIG. 6 shows a flow diagram for a method 600 for communicating with the downhole tool 126 in accordance with principles disclosed herein. Though depicted sequentially as a matter of convenience, at least some of the actions shown can be performed in a different order and/or performed in parallel. Additionally, some embodiments may perform only some of the actions shown. In some embodiments, at least some of the operations of the method 600, as well as other operations described herein, can be implemented as instructions stored in a computer readable storage device 504 and executed by the processor 502.

In block 602, the downhole tool 126 is disposed in the borehole 116. The downlink receiver 128 is monitoring rotation/axial motion of the downhole tool 126 to identify a control information transfer sequence initiated by the equipment at the surface. In some embodiments, the rotation processing module 400 of the downlink receiver 128 is processing rotation sensor outputs, and generating a rotation rate value for the tool 126.

In block 604, the surface equipment initiates a control information transfer sequence by manipulating the rotation/non-rotation/axial motion of the downhole tool 126 to transmit a preamble sequence. The preamble sequence may include a period of non-rotation 202 followed by a plurality of subsequent rotation/non-rotation intervals 204, for example, as shown in FIG. 2A, or other motions as shown in FIGS. 2B-2E. Thus, the surface equipment causes the downhole tool 126 to move axially/rotate/not rotate in accordance with a predetermined preamble timing and pattern.

In block 606, the downlink receiver 128 detects the preamble sequence indicating initiation of control information transfer, and begins listening for (e.g., timing) the command/parameter that follows the preamble.

In block 608, the surface equipment initiates transmission of a command/parameter (control information) immediately subsequent to the preamble. The value of the command/parameter may be encoded as a duration of rotation of the downhole tool 126, axial motion of the downhole tool 126, etc. Thus, the surface equipment may cause the downhole tool 126 to rotate for a duration and/or speed indicated by the command/parameter to be transmitted to the downhole tool 126.

In block 610, the downlink receiver 128 receives and decodes the control information transferred from the surface. The downhole tool 126 executes a command and/or applies a parameter received with the control information in block 612. Execution of the command and/or application of the parameter may modify or otherwise direct the operation of the downhole tool 126.

As explained above, the downhole tool 126 can be any of various types of downhole equipment whose operation can be facilitated by receiving control information from the surface. For example, the downhole tool 126 may be a reamer. A reamer is a tool that operates by expanding cutters above the drill bit 114 to increase the diameter of the borehole 116 to be equal or larger than the bore created by operation of the drill bit 114. Conventional reamers allow selective activation of cutters and in some cases allow the cutters to be locked from opening with drilling flow rates present, using a ball drop method. In conventional reamers, once the cutters are deactivated or the ball catcher is full the reamer must be withdrawn from the borehole 116 and reset to enable further use.

A reamer including the downlink receiver 128 allows surface equipment to selectively activate and deactivate the reamer an unlimited number of times. FIG. 7A-7G show longitudinal cutaway views of a reamer 700 controllable via downlink communication in accordance with principles disclosed herein. The reamer 700 includes selectably extendable cutters 702, a piston 704 that operates to extend the cutters, a valve 709 that controls fluid drive to the piston 704, a downlink receiver 128 and a command actuator 308 that controls the valve 709. The valve 709 may block flow completely to the activation piston 704 or allow a small continuous bypass of flow to the annulus through the piston chamber if the chamber is equipped with a nozzle flow path when the cutters 702 are deactivated. When the reamer 700 is activated, additional flow may be allowed into the activation piston chamber to provide the pressure increase needed to activate the reamer cutters 702. The extension and retraction of the cutters 702 is controlled via command from the surface equipment received via the downlink receiver 128. The degree, distance, or percentage of total extension of the cutters 702 can also be controlled via command from the surface equipment received via the downlink receiver 128.

Figure 7A:
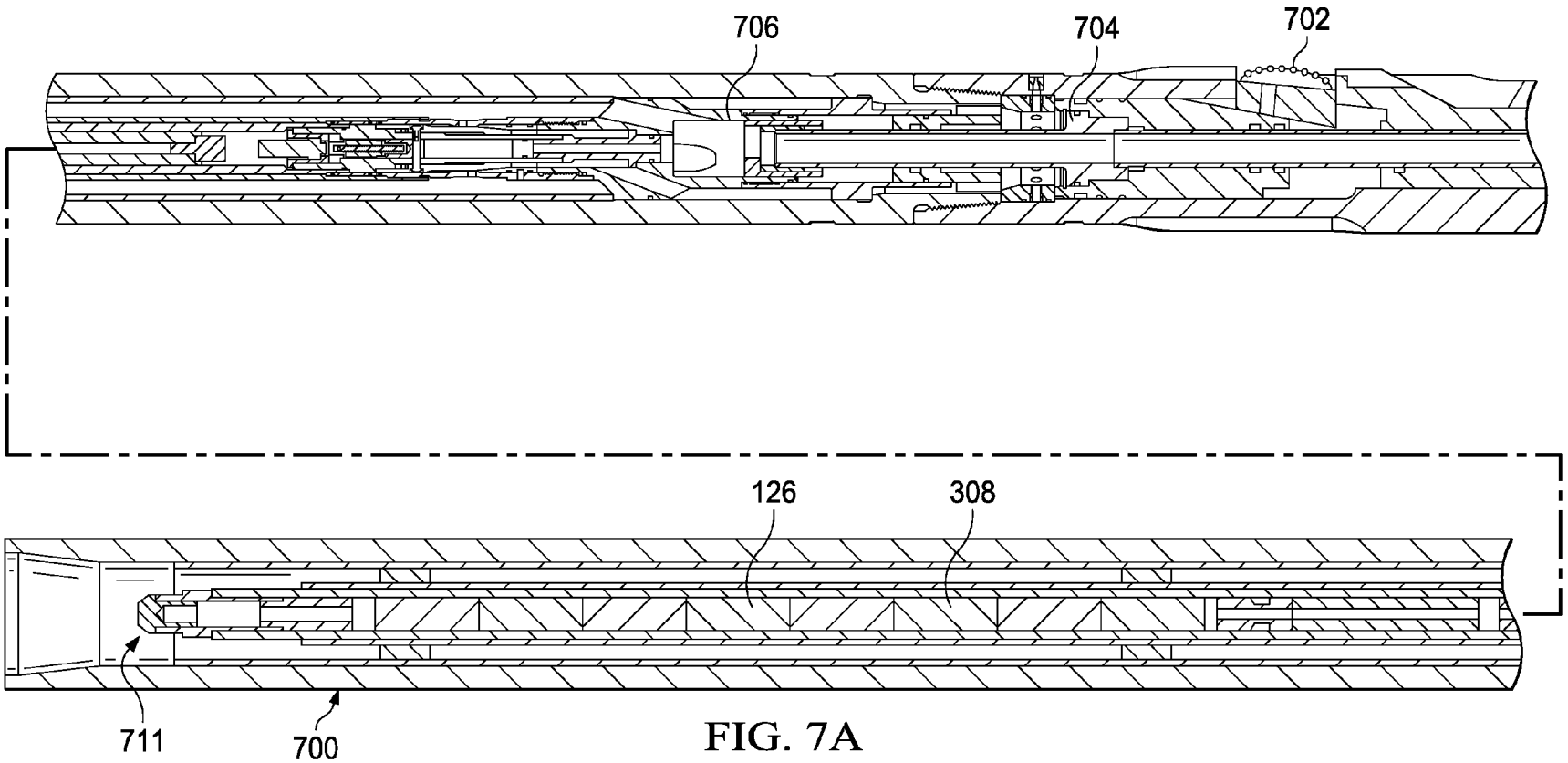
FIGS. 7A-7C shows longitudinal cutaway views of a reamer controllable via downlink communication in accordance with principles disclosed herein.
Figure 7B:
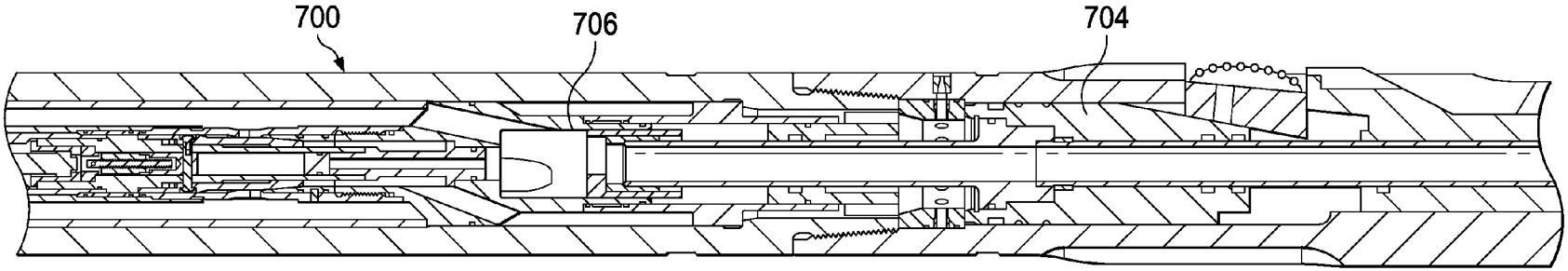
Figure 7C:
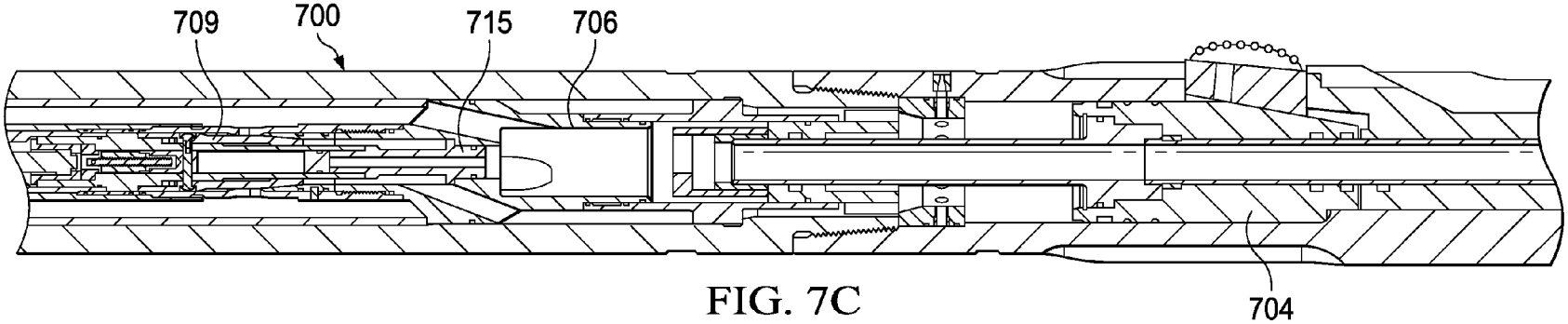
Figure 7D:
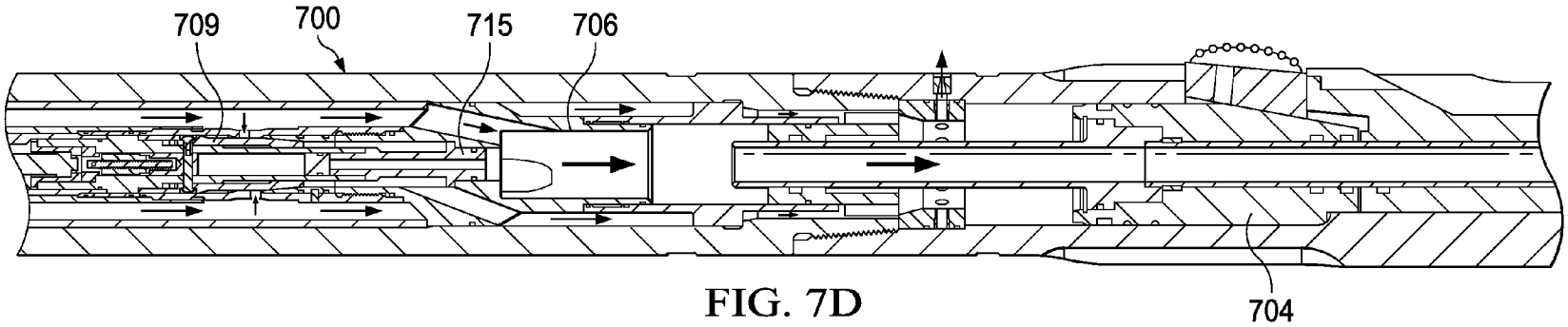
FIG. 7D shows the reamer embodiment in the open position with the control valve open and flow arrows showing where fluid is passing during operation.
Figure 7E:
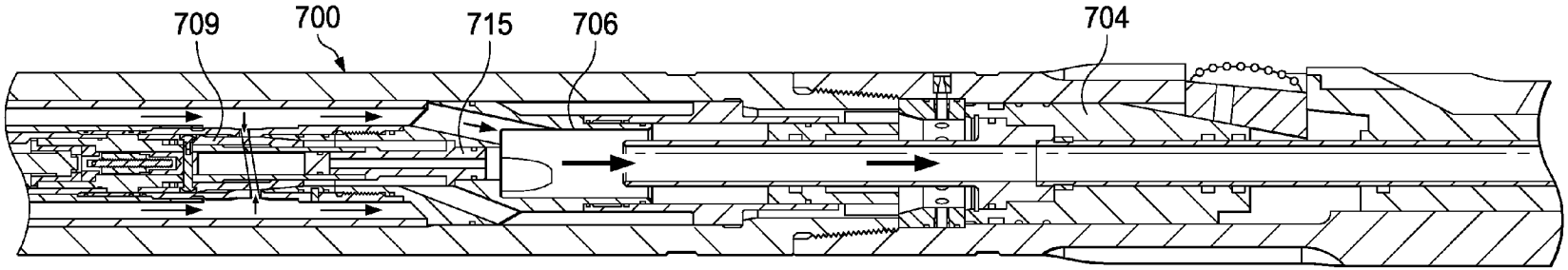
FIG. 7E shows the reamer embodiment in the closed position with the control valve closed and flow arrows showing where fluid is passing during operation.
Figure 7F:
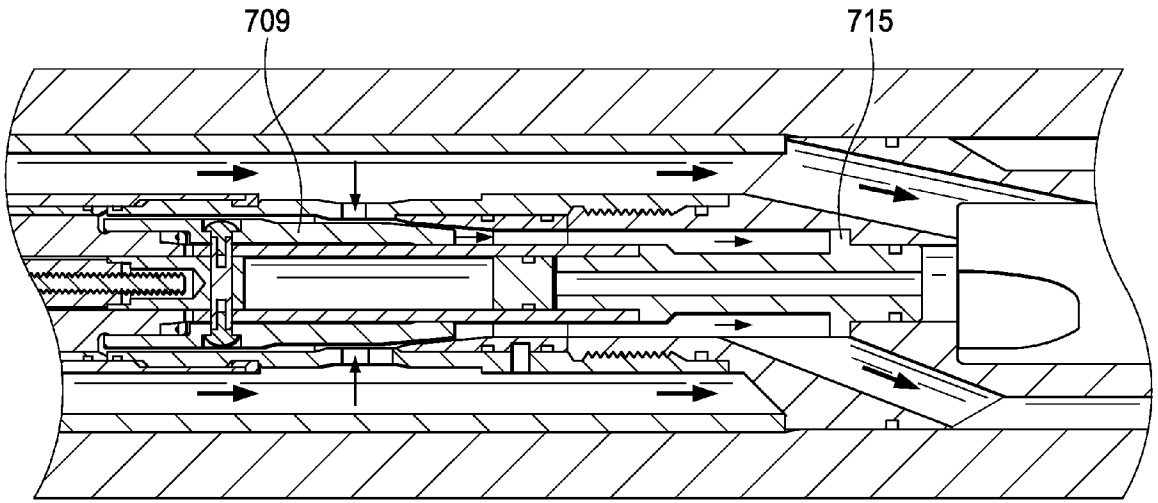
FIG. 7F shows a zoomed in image of the control valve in the open position.
Figure 7G:
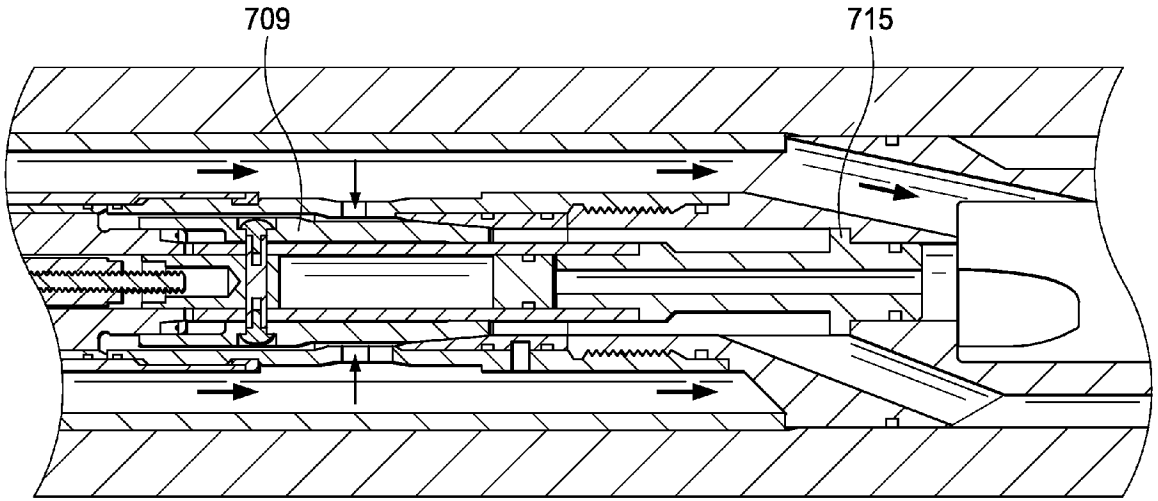
FIG. 7G shows a zoomed in image of the control valve in the closed position.

FIG. 7B shows the position of the piston 704 while the cutters 702 are retracted. When the tool is in this position valve 709 is closed, moved to the downhole side of the valve travel, and does not allow significant flow to enter the activation piston chamber. FIG. 7C shows the position of the piston 704 while the cutters 702 are extended. When the tool is in this position valve 709 is open, moved to the uphole side of the valve travel, and allows significant flow to enter the activation piston chamber, thus building pressure in this area to extend the cutters. The flow path through the assembly with the cutters active and valve 709 open is as shown in FIG. 7D with the flow arrows.

Multiple instances of the reamer 700 can be included in drill string 108 and selectively activated below restrictions that would inhibit operation of ball drop activated tools. The reamer 700 may also allow mechanical deactivation of the cutters 702 by dropping a ball in the event of a failure in the electronics (e.g., battery or circuitry of the downlink receiver 128, etc.). Accordingly, the reamer 700 may include a ball catcher 711 at the top of the control system as shown in FIG. 7A. Dropping a ball into the ball catcher 711 creates a pressure drop. The resulting hydraulic differential pressure pushes the central components downward. The downward force shears ring 715 in the control system and allows the two valve components 709 to move relative to one another, thus mechanically closing the reamer piston control valve. Once the valve 709 is closed, the mechanical reamer assembly pulls the cutters 702 in using spring force or hydraulic force when the pumps are turned on. This method adds an additional factor of safety by ensuring the cutters 702 can be retracted even if the control system has completely failed.

In another embodiment, the downhole tool 126 may be a positive displacement mud motor or turbine. A mud motor or turbine is used in drilling to provide power or rotation of the drill bit by pumping fluid under pressure through the motor. The motor allows the operator to turn the drill bit without having to turn the entire drill string or drill pipe. Conventionally, motors have a set RPM range that is not adjustable without pulling the motor and changing the type of power section being used.

A motor/turbine including the downlink receiver 128 allows surface equipment to selectively change the RPM of the motor at a given flow rate by bypassing a portion of the drilling flow to the annulus above the motor's/turbine's power section. In an alternative embodiment, such RPM control can be accomplished by attaching a control valve similar to the control valve 709 to the rotor of the motor/turbine and bypassing a portion of the flow through a central passage in the rotor. In such an embodiment, fluid can enter the housing of the valve and pass through the rotor of the motor, thus bypassing the Moineau power section and reducing the speed of the rotor. By using rotational and/or axial movement commands from the surface with no flow present, the RPM of the motor can be controlled with simple commands to speed up or slow down the bit as needed to meet the RPM demands of changing rock formation types while drilling.

In a further embodiment, the downhole tool 126 may be a multiple opening circulating sub. A circulating sub is used in drilling to bypass all or a portion of the mud flow to the drill bit. Conventional circulating subs are activated via drop balls or with changes in mud flow. A circulating sub including the downlink receiver 128 allows surface equipment to selectively change the amount of fluid bypassing the bit. Using a valve similar to valve 709 and adding a small nozzle passage through the outer body below the floater piston a circulating sub can be activated or deactivated by sending rotational commands or rotational and axial movement commands to the tool. By attaching the receiver 128 and valve similar to 709 to the lower end of a circulating sub, such as the circulating sub described in WIPO Pub. WO2009/067588, the floater piston can be balanced and unbalanced by shifting valve 709 to allow flow into the chamber below the floater piston. When the valve 709 is open the floater piston sees the tools internal bore pressure and the circulating sub is not allowed to open to the annulus. When the valve 709 is closed (no flow) an additional small bleed passage through the outer body of the circulating sub prevents pressure from building below the floater piston and keeps the chamber at the annulus pressure. When the pumps are turned on, the ported valve piston shifts downward and allows the circulating sub valve to open, thus allowing all or a portion of drilling fluid to flow to the annulus through the body ports.

In a yet further embodiment, the downhole tool 126 may be a thruster. A thruster is a stroking tool used in drilling to maintain weight on bit (WOB) by using the mud pressure generated by pumping the fluid through the drill bit. The thruster allows force to be applied to the drill bit without moving the drill pipe up and down continually. The pressure differential across the tool and drill bit are multiplied by the piston area inside the thruster and provide a WOB force to allow the bit to cut the formation. Conventional thrusters are not variable and provide a set WOB for a given flow rate. A thruster including the downlink receiver 128 and a valve similar to the valve 709 allows surface equipment to selectively change the WOB at the bit by moving the valve to increase or decrease the flow area below the piston of the thruster. By opening the valve the differential pressure across the tool decreases based on the flow area controlled by the valve and can be set to any of a plurality (e.g., any value in a range) of WOB values by sending rotational commands or rotational and axial movement commands to the tool. Similarly, by closing the valve, the resulting differential pressure across the tool increases based on the flow area controlled by the valve thus increasing the WOB applied to the drill bit.

The above discussion is meant to be illustrative of various embodiments of the present invention. Numerous variations and modifications will become apparent to those skilled in the art once the above disclosure is fully appreciated. It is intended that the following claims be interpreted to embrace all such variations and modifications.

What is claimed is:

1. A system for downhole communication, comprising:
- a downhole tool comprising:
  - a downlink receiver to receive control information that controls operation of the downhole tool, the control information encoded in rotation of the downhole tool, the downlink receiver comprising:
    - a rotation sensor configured to sense rotation of the downhole tool about a longitudinal axis of the downhole tool; and
    - a decoder configured to:
      - demarcate fields of the control information based on rotation state transitions sensed by the rotation sensor, wherein the rotation state transitions are transitions between a rotating state and a non-rotating state of the downhole tool, wherein in the non-rotating state the downhole tool is rotated at approximately zero revolutions per minute; and
      - decode a control value for controlling the downhole tool based on a duration of a field of the control information, wherein the control value is wholly encoded in the field and the field is encoded as a non-rotating state of the downhole tool; and
  - a command actuator that applies the control value to control operation of the downhole tool.

2. The system of claim 1, wherein the decoder is configured to identify a preamble field of the control information as an interval of non-rotation followed by a plurality of transitions from the rotating state to the non-rotating state.

3. The system of claim 1, wherein the decoder is configured to identify a polarity designation value that specifies whether the control value is encoded wholly in the rotating state or wholly in the non-rotating state.

4. The system of claim 3, wherein the decoder is configured to identify the field containing the control value as an interval of non-rotation immediately subsequent to a field containing the polarity designation value.

5. The system of claim 1, wherein the decoder is configured to:
- identify the rotating state as rotation of the downhole tool at rate higher than a first predetermined value; and
- identify the non-rotating state as rotation of the downhole tool at a rate lower than a second predetermined value.

6. The system of claim 1, wherein the downlink receiver comprises a timer configured to measure a time duration of each identified field of the control information; and wherein the decoder is configured to identify the control value in correspondence to the time duration of the field in which the control value is encoded.

7. A method for downhole communication, comprising:
- rotating a downhole tool at a first rotation rate to place the downhole tool in a rotating state;
- halting rotation of the downhole tool to place the downhole tool in a non-rotating state, wherein in the non-rotating state the downhole tool is rotated at approximately zero revolutions per minute;
- encoding control information for controlling the downhole tool in a series of transitions between the rotating state and the non-rotating state;
- detecting, by the downhole tool, the transitions between the rotating state and the non-rotating state;
- demarcating, by the downhole tool, fields of the control information based on the detected transitions;
- decoding, by the downhole tool, a control value for controlling the downhole tool based on a duration of a field of the control information, wherein the control value is wholly encoded in the non-rotating state; and
- applying the control value to control operation of the downhole tool.

8. The method of claim 7, wherein the extracting comprising:
- measuring a time interval between each transition between the rotating state and the non-rotating state; and
- identifying the control value based on a measured time duration of the field in which the control value is encoded.

9. The method of claim 7, further comprising identifying a preamble field of the control information as an interval of non-rotation followed by a plurality of transitions from the rotating state to the non-rotating state.

10. The method of claim 7, further comprising identifying, in the control information, a polarity designation value that specifies whether the control value is encoded wholly in the rotating state or wholly in the non-rotating state.

11. The method of claim 10, further comprising identifying the field containing the control value as an interval of non-rotation immediately subsequent to a field containing the polarity designation value.

12. The method of claim 7, further comprising:
- identifying the rotation state as rotation of the downhole tool at rate higher than a first predetermined value; and identifying the non-rotation state as rotation of the downhole tool at a rate lower than a second predetermined value.

13. A method for downhole communication, comprising:

transmitting control information from a surface location to a downhole tool disposed in a borehole by repetitively raising or lowering the downhole tool in the borehole;

detecting, by the downhole tool, motion of the downhole tool along a longitudinal axis of the downhole tool;

extracting, by the downhole tool, the control information from the motion by demarcating fields of the control information based on the detected motion of the downhole tool along the longitudinal axis;

measuring a time duration of each of the fields of the control information; and determining a value of the control information to be applied to control the downhole tool in correspondence to the time duration of one of the fields of the control information; and applying, by the downhole tool, the control information extracted from the motion to control the operation of the downhole tool.

14. The method of claim 13, wherein the transmitting control information comprises rotating the downhole tool about the longitudinal axis; and the method further comprises detecting, by the downhole tool, rotation of the downhole tool about the longitudinal axis; wherein the extracting comprises detecting the control information based on the detected rotation of the downhole tool being at a predetermined rate.

15. The method of claim 13, wherein the demarcating comprises identifying a preamble field and identifying an information value of the control information transmitted subsequent to the preamble field.

16. The method of claim 13, wherein the extracting comprises identifying each sensed initiation of motion along the longitudinal axis as a change of state of the control information.

17. The method of claim 13, wherein the extracting comprises identifying a first sensed initiation of motion along the longitudinal axis followed by a second sensed initiation of axial motion along the longitudinal axis as initiation of a preamble field of the control information.

18. The method of claim 17, further comprising detecting rotation of the downhole tool about the longitudinal axis; wherein the extracting comprising demarcating fields of the control information based on sensed changes in rate of rotation of the downhole tool.

19. The method of claim 13, wherein the extracting comprises:

identifying a first sensed initiation of motion along the longitudinal axis as initiation of a preamble field of the control information; and identifying a second sensed initiation of motion along the longitudinal axis as termination of the control information.

20. The method of claim 19, further comprising detecting rotation of the downhole tool about the longitudinal axis; wherein the extracting comprising demarcating fields of the control information based on sensed changes in rate of rotation of the downhole tool.

21. A method for downhole communication, comprising:

rotating a drill string in a first direction via a drill string rotation mechanism disposed at a surface location;

during the rotating in the first direction, successively engaging and disengaging a downhole motor disposed in the drill string to cause reversals in direction of rotation of a drill bit and a downhole tool disposed downhole of the downhole motor in the drill string;

timing the reversals in direction of rotation to encode control information for controlling the operation of the downhole tool;

detecting, by the downhole tool, the reversals in direction of rotation;

extracting, by the downhole tool, the control information from the rotation by demarcating fields of the control information based on the detected reversals in direction of rotation;

measuring a time interval between each reversal of direction of rotation;

determining a value of the control information applied to control operation of the downhole tool based on a time interval between two successive reversals of direction of rotation; and applying the extracted control information to control operation of the downhole tool.

* * * * *